US010149073B2

(12) United States Patent
Polinske et al.

(10) Patent No.: US 10,149,073 B2
(45) Date of Patent: Dec. 4, 2018

(54) SYSTEMS AND METHODS FOR HEARING ASSISTANCE RF MULTI-BAND OPERATION

(71) Applicant: Starkey Laboratories, Inc., Eden Prairie, MN (US)

(72) Inventors: Beau Jay Polinske, Minneapolis, MN (US); Stephen Paul Flood, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 411 days.

(21) Appl. No.: 14/451,098

(22) Filed: Aug. 4, 2014

(65) Prior Publication Data

US 2016/0037270 A1 Feb. 4, 2016

(51) Int. Cl.
*H04R 25/00* (2006.01)

(52) U.S. Cl.
CPC ..... *H04R 25/554* (2013.01); *H04R 25/558* (2013.01); *H04R 2225/51* (2013.01); *H04R 2225/55* (2013.01)

(58) Field of Classification Search
CPC ..... H04R 2225/55; H04R 2225/51; H04R 25/30; H04B 17/309; H04B 1/3827; H04B 7/0802; H04W 4/008; H04W 8/005; H04M 1/6066; H04M 1/7253; H04M 1/72591; H04M 2250/02
USPC ..... 381/315, 23.1, 60; 455/41.2, 569.1
See application file for complete search history.

(56) References Cited

U.S. PATENT DOCUMENTS

| | | | | |
|---|---|---|---|---|
| 7,062,223 | B2 | 6/2006 | Gerber et al. | |
| 7,778,432 | B2 | 8/2010 | Larsen | |
| 8,442,248 | B2 * | 5/2013 | Solum | H04R 25/554 370/437 |
| 2009/0074216 | A1 | 3/2009 | Bradford et al. | |
| 2010/0054512 | A1 | 3/2010 | Solum | |
| 2010/0158292 | A1 | 6/2010 | Pedersen | |
| 2014/0064528 | A1 | 3/2014 | Flood et al. | |

FOREIGN PATENT DOCUMENTS

| | | | |
|---|---|---|---|
| EP | 2403273 | A1 | 1/2012 |
| EP | 2747296 | A2 | 6/2014 |
| EP | 2871857 | A1 | 5/2015 |
| WO | WO-2012092973 | A1 | 7/2012 |

OTHER PUBLICATIONS

"European Application Serial No. 15179643.0, Extended European Search Report dated Mar. 23, 2016", 7 pgs.
"European Application Serial No. 15179643.0, Communication pursuant to Article 94(3) EPC dated Jan. 4, 2017", 5 pgs.

* cited by examiner

*Primary Examiner* — Phylesha Dabney
(74) *Attorney, Agent, or Firm* — Schwegman Lundberg & Woessner, P.A.

(57) ABSTRACT

The present disclosure relates to a multi-band wireless communication of information for a hearing assistance device, where the multi-band operation is adapted to provide communications at different radio frequency (RF) bands. In applications of hearing aids, the processor is adapted to perform correction of sound for a hearing impaired user. In certain examples, the present subject matter provides an improved data transmission integrity and reliability.

27 Claims, 5 Drawing Sheets

SYSTEMS AND METHODS FOR HEARING ASSISTANCE RF MULTI-BAND OPERATION

FIELD OF THE INVENTION

The present subject matter relates generally to hearing assistance devices, and in particular to radio frequency (RF) multi-band operation for hearing assistance devices.

BACKGROUND

Modern hearing assistance devices typically include digital electronics to enhance the wearer's experience. In the specific case of hearing aids, current designs employ digital signal processors rich in features. The operation and maintenance of wireless hearing aids may be improved or simplified by improving the wireless communication components within the hearing aid. Some wireless hearing aids have sought to improve wireless performance by using various wireless protocols, error concealment, or data encoding within a radio frequency (RF) band to improve link quality. However, these solutions have been limited by RF congestion within an RF band, causing lower data rates and unreliable communication. The use of multiple RF bands (e.g., multi-band operation) may be complicated by the various frequencies available in different countries. Additionally, the amount of absorption of radio signals changes significantly with frequency of the signals. Furthermore, communications at different frequencies can require substantially different electronics in various cases.

What is needed in the art is an improved method of wireless communications in hearing assistance devices.

SUMMARY

Disclosed herein, among other things, are methods and apparatus for hearing assistance devices, including but not limited to hearing aids, and in particular to multi-band radio operation for hearing assistance devices.

The present disclosure relates to multi-band wireless communication of information for a hearing assistance device, where the multi-band operation is adapted to provide communications at different radio frequency (RF) bands. In applications of hearing aids, the processor is adapted to perform the multi-band operation and correction of sound for a hearing-impaired user. In certain examples, the present subject matter provides improved data transmission integrity and reliability.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Disclosed herein, among other things, are methods and apparatuses for multi-band transmission of radio waves from an RF source to an antenna, such as in a compact hearing aid design.

A multi-band radio design may be implemented using multiple radios or a single radio. A single, multi-band radio design may simplify manufacture and distribution of hearing aids by reducing the number of hearing aids and hearing aid part numbers that need to be manufactured and tracked. A single hearing aid with multiple bands of operation may be used in various hearing aid product lines, where the multiple bands of operation may be enabled or disabled for each product line, thereby yielding more flexibility in the tiers of hearing aid products. Multi-band operations may be available using various multi-band radios, including the CC13xx radios manufactured by Texas Instruments (Chipcon) that operates at both 900 MHz and 2.4 GHz.

Frequencies available for wireless communication, such as the industrial, scientific and medical (ISM) radio bands at 900 MHz (e.g., 902 MHz to 928 MHz) and 2.4 GHz (e.g., 2.4 GHz to 2.5 GHz), offer a large amount of bandwidth and allow sufficient RF power to cover many uses for hearing assistance devices. However, different countries apply varying RF restrictions, and frequencies around 900 MHz are not allocated for worldwide coverage. As described below, a wireless hearing assistance system may improve its wireless performance by using multiple RF bands either alternatively or simultaneously.

Figure 1:
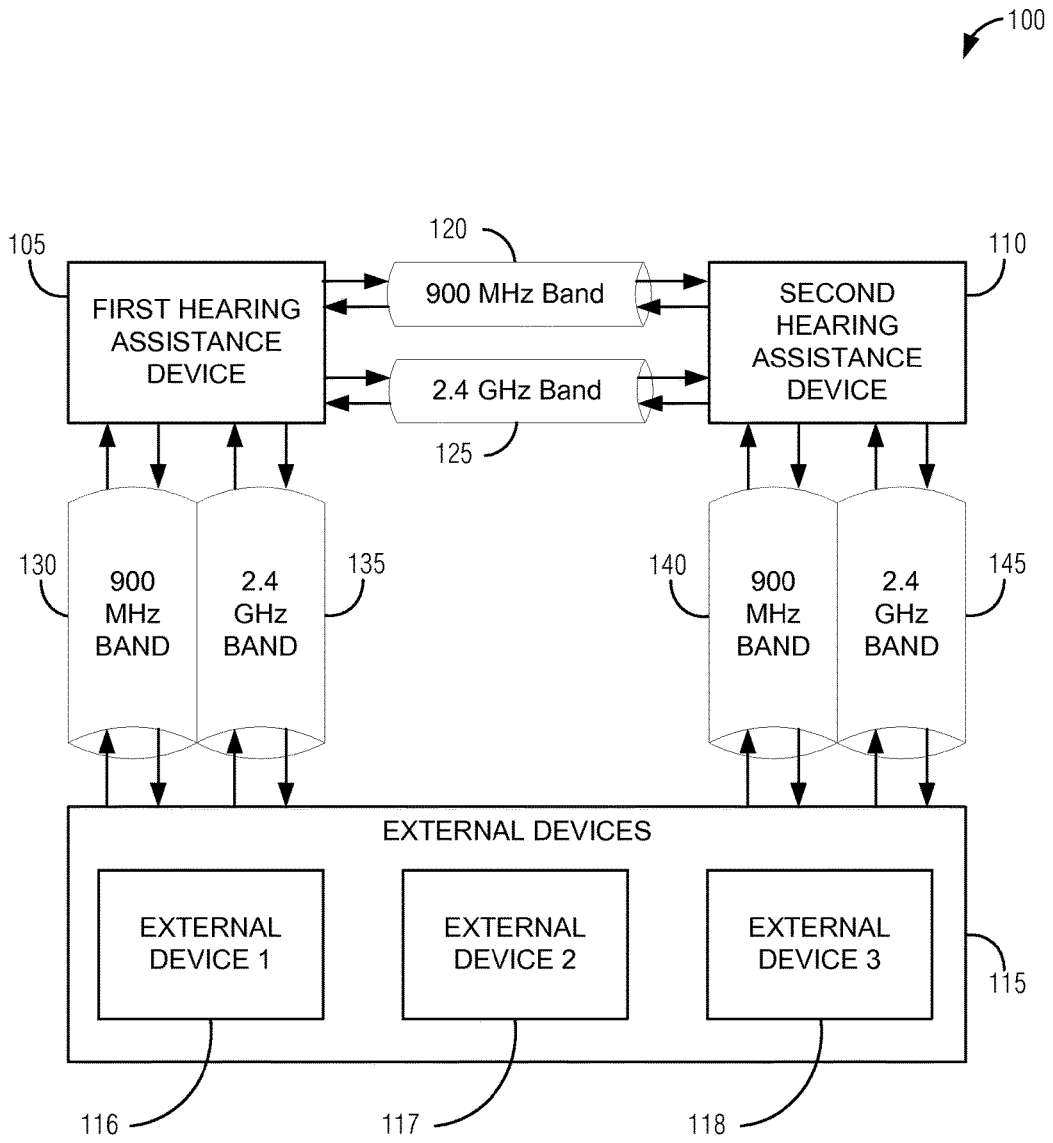
FIG. 1 shows an example RF multi-band hearing assistance system.

FIG. 1 shows an example RF multi-band hearing assistance system 100. The electronic circuitry of a hearing aid is contained within a housing that is commonly placed either in the external ear canal or behind the ear. In an example embodiment, a hearing assistance system includes two hearing aids for providing audio outputs to both ears, such as first hearing assistance device 105 and second hearing assistance device 110 shown in FIG. 1. Each of the two hearing aids 105 and 110 may include two or more RF components, which may include a 900 MHz band RF component 120, 130, or 140, or may include a 2.4 GHz band RF component 125, 135, or 145. The links 120 and 125 between the first and second hearing assistance devices 105 and 110 may be different from the external links 130, 135, 140, 145 to the external devices 115. Though FIG. 1 depicts the use of a 900 MHz band and a 2.4 GHz band, other wireless communication links may be used. For example, wireless communication links may include cellular bands (e.g., GSM, CDMA, WCDMA, LTE), local wireless network protocols (e.g., Wi-Fi, 802.11, Zigbee, 802.15.6, Bluetooth), short-range wireless communication links (e.g., Near Field Communication (NFC), Near Field Magnetic Induction (NFMI), Infra-Red (IR)), or other wireless communication links.

The RF components may be used to generate an RF link used to communicate between the first hearing assistance device 105 and the second hearing assistance device 110. Either hearing aid may also communicate through an RF link with one or more external devices 115, such as a dedicated external hearing aid programmer 116, a personal computer 117, a smart phone 118, or additional devices. Information about the types of RF bands and protocols supported by the external devices 115 may be communicated to the first or second hearing assistance devices 105 and 110, which may use that information when making decisions on band usage. In certain embodiments, an RF link may be used to convey programming data, audio data, control data, or other data.

The RF band may be selected based on trade-offs between power consumption and performance. For example, the 900 MHz band may have associated propagation characteristics that favor a specific mode of operation, and the 2.4 GHz band may have associated propagation characteristics that favor other modes of operation. Similarly, 2.4 GHz band operation may require a higher current consumption than the 900 MHz band, which can limit battery performance. The RF band of operation might use frequencies other than 900 MHz or 2.4 GHz. The use of a multi-band radio within a hearing aid may enable the hearing aid to overcome propagation losses in various RF bands, thereby improving wireless performance or battery performance.

The use of multiple RF bands may also extend the usable life for accessories or other hearing aid peripheral devices, as the devices may not become obsolete as new hearing aids are marketed. For example, audiologists may use a smartphone-based hearing aid programmer, and while hearing aid ear-to-ear communication performs well at 900 MHz communication, a smartphone may be limited to the Bluetooth radio (e.g., BT, BLE) built into the phone. By including multiple bands within the hearing aid, the hearing aid may retain compatibility with cellular phones and other programmers.

Figure 2:
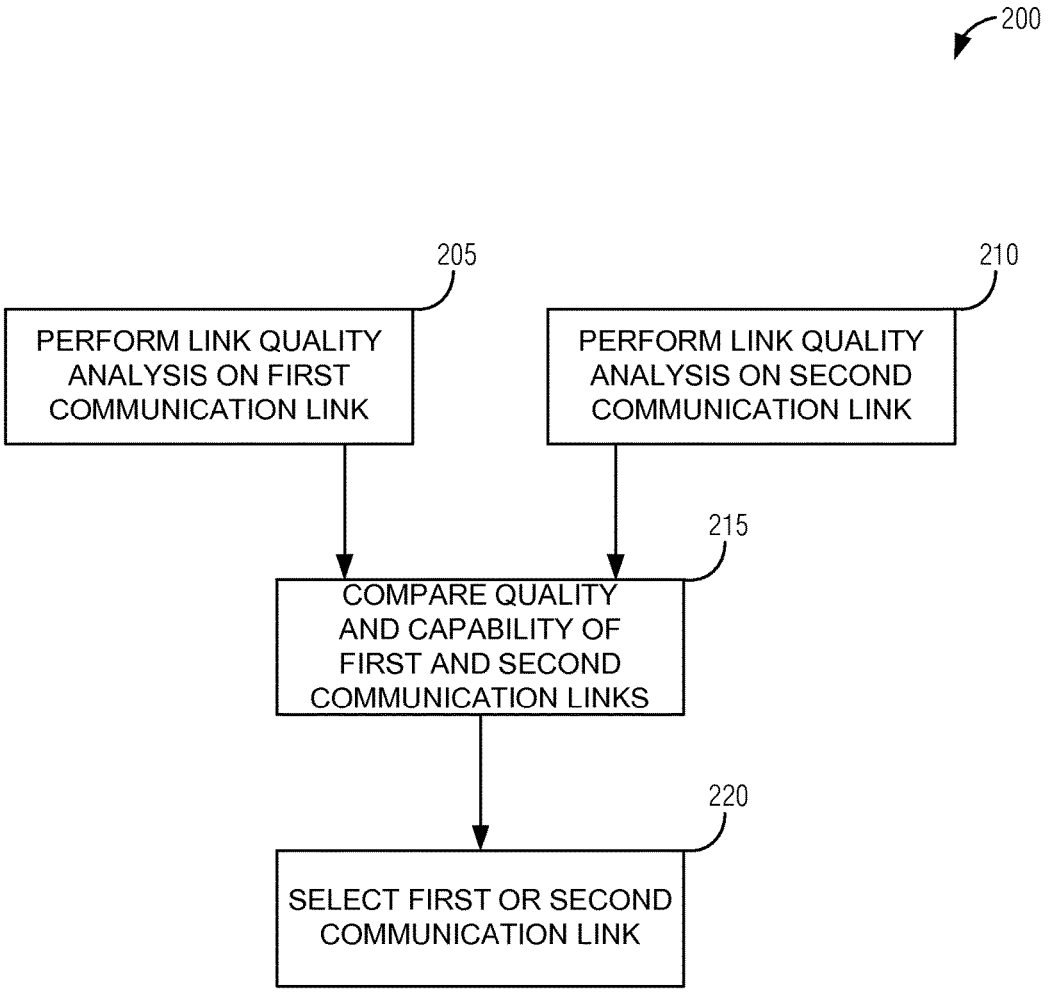
FIG. 2 shows an example hearing assistance RF multi-band method of comparing independent communication link qualities and capabilities.

FIG. 2 shows an example hearing assistance RF multiband method of comparing independent communication link qualities and capabilities 200. The independent link comparison method 200 may include performing a link quality analysis (LQA) on a first communication link 205 and performing LQA on a second communication link 210. The first and second communication links 205 and 210 may be different RF bands, such as the 900 MHz or 2.4 GHz bands. The LQA may be performed by a hearing aid or by a device connected to a hearing aid. The LQA may use various signal quality measurements (e.g., metrics, indicators) to analyze the quality of each RF band, such as a received signal strength indicator (RSSI), packet error rate (PER), bit error rate (BER; e.g., bit error ratio), signal-to-noise ratio (SNR), signal-to-noise and distortion ratio (SINAD), or other signal quality measurements. For example, for adaptive high-frequency radio, LQA may be automatically performed based on analyses of pseudo-BERs and SINAD readings. The link quality may be determined independently for each communication link. LQA measurements may be stored at or exchanged between hearing aids or external devices, and may be used to determine how RF communication links are established. Independent LQA may allow a communication link to continue to perform its own LQA, which may be used when another link is non-functional or is not providing sufficient information to determine its link quality. Though independent link comparison method 200 shows performing LQA for two communication links, the LQA may be performed for additional communication links or additional communication bands.

Once LQA has been performed for available communication links, the independent link comparison method 200 compares the link qualities and capabilities 215. Using the results of the comparison, the independent link comparison method 200 then selects one of the communication links 220 to be used for communication of data signals, audio signals, control signals, or other RF signals. The selection of the communication link may be based on a combination of metrics, analyses, or other selection criteria. If the selection of the communication link is based on a link quality metric, the selected link may correspond to the link with the higher quality metric. For example, the selected link may correspond to the link with the highest RSSI value, or the selected link may correspond to the link with the lowest PER value. The selection of the communication link may be based on other signal analyses. For example, in a system using a 900 MHz band and a 2.4 GHz band, the communication link selection may consider propagation characteristics of each band. For example, in a system using a 900 MHz band and a 2.4 GHz band, the communication link selection may consider propagation characteristics of each band, including considering which band may have better signal range in specific environments. The selection of the communication link may be based on the time-criticality of the type of intended data transmission. In hearing assistance systems, the reception of transmitted audio data may be considered more time-critical than the reception of transmitted programming data. For example, if the first hearing assistance device 105 is being reprogrammed wirelessly using a remote programmer external device 115, the received data may be tested for data corruption, and may be retransmitted if it is determined to be corrupted. However, it is less practical to retransmit audio data to a hearing assistance device, as hearing a time-delayed copy of audio may confuse the listener. For example, if the 900 MHz band has higher signal strength than the 2.4 GHz band but exhibits more data errors, then the independent link comparison method 200 may select the 2.4 GHz band for use in transmitting audio data. Based upon the quality of the communication link for the band chosen, the independent link comparison method 200 may send a redundant RF packet transmission for more reliable communication, or may send a single transmission for lower power consumption. The method 200 may be performed once at the beginning of a transmission of known duration to identify a preferred RF band for the transmission. For example, the concurrent communication link method 400 may select an RF band for transmission of a large block of data used to reprogram a hearing aid, and the selected RF band may be used to receive the entire large block of reprogramming data.

Figure 3:
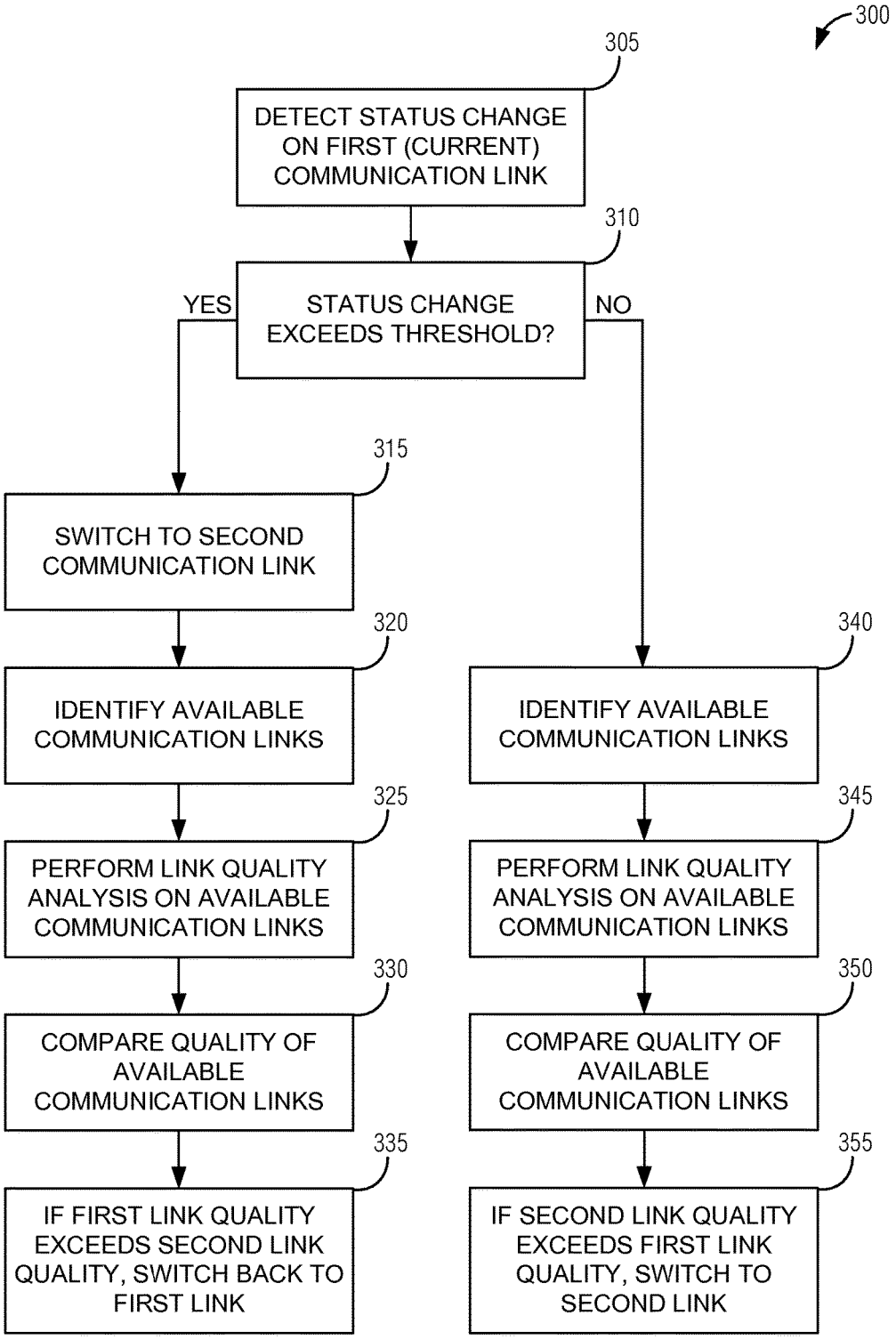
FIG. 3 shows an example hearing assistance RF multi-band method of changing communication links in response to a communication status change.

FIG. 3 shows an example hearing assistance RF multiband method of changing communication links in response to a communication status change 300. The status change method 300 may include detection of various status changes on the current communication link, including degraded communication link performance, a multipath event, a low battery warning, a geographic update, or other status changes. Degraded performance may include multipath fading, signal congestion, our other signal degradation within a particular RF band. A multipath event may be independent from degraded performance. For example, multipath events may occur without immediately degrading performance, but may be an indication that signal degradation is likely to occur. Degraded performance or a multipath event may be caused by various RF environment issues, where some RF environment issues may be specific to an RF band. For example, the 900 MHz band may be degraded due to multi-path fading, or the 2.4 GHz band can become congested with Wi-Fi and other traffic. The detection of a status change on a first communication link 305 may be detected within the hearing assistance device application layer, within the hearing assistance device physical layer (PHY), or within another Open Systems Interconnection (OSI) model layer. In addition to operations performed in a hearing aid application layer, the firmware may be used to test link quality in both bands and select the higher performing band for operation. The firmware may also be used to change modulation, data rate, or codec dynamically, where the changes may be based on reliable bandwidth available in either band.

Upon detection of a status change on a first (current) communication link 305, the status change method 300 may test whether the status change exceeds a status threshold 310. For example, status change method 300 may test whether the degraded performance falls below a minimum performance threshold, whether the multipath event exceeds a permissible multipath error threshold, whether the battery level falls below a low battery threshold, or whether a geographic update exceeds a geographical change threshold. The hearing aid manufacturer, the hearing aid user, or the audiologist may configure one or more thresholds.

If the status change threshold test determines the status change exceeds the corresponding threshold, status change method 300 may immediately switch to a second communication link 315. For example, a hearing aid application layer may detect degraded performance on the currently used 900 MHz band, and the application layer may immediately switch the band of operation to the 2.4 GHz band. Immediate switching may improve the continuity in the RF transmission, such as may be desirable in a continuous audio transmission. Immediate switching may prevent the need to perform LQA continuously on multiple RF bands, where continuous LQA may consume additional power without significantly improving user experience.

After immediately switching to a second communication link 315, the status change method 300 may perform additional analysis to determine whether the first or second communication link will provide better performance, such as in steps 320, 325, or 330. The additional analysis may include identifying all available communication links 320. The availability of communication links may be based on the types of radios within the hearing aid, the RF bands that may be used in the current geographic location, the use of alternative radios within the hearing aid for other purposes, or other criteria. A first RF band may be used to determine availability or operation information about a second band. While multiple carrier frequencies may be available for multi-band hearing aid operation, the choice of RF band often depends on national regulations governing the frequency bands available for wireless data transmission. A multi-band radio may improve compliance with local RF band regulations. Even if a hearing aid includes an alternative communication link, the alternative communication link may use an RF band that is impermissible or heavily regulated in the current geographic region. For example, hearing aid applications in the United States may use the 902-928 MHz band, whereas the European Union may use the 865 MHz SRD band. The location information may be stored in the hearing aid or may be transmitted to the hearing aid using an external device. For example, the hearing aid may receive a location from a cellular phone via Bluetooth, where the cellular phone determined its location using the cellular tower. The hearing aid may use the geographic information to identify the locally permissible 900 MHz frequency and protocol allocation. The hearing aid may use the information about locally permissible RF bands in identifying available alternative communication links 320. In various embodiments, each hearing aid may reconfigure itself automatically to operate in the RF band appropriate for its location.

Once available alternative communication links have been identified 320, an LQA may be performed on each available communication link 325. The LQA may perform its analysis using information about the degraded performance of the first communication link. For example, if the hearing aid detects multipath interference on one RF band, the LQA may focus on whether another available RF band also exhibits degraded performance due to multipath, Wi-Fi interference, or other interference. The LQA may be used to compare the quality of all available communication links 330. The communication link quality comparison 330 may be based on the user application (e.g., use case), on propagation characteristics, or on other considerations. In some embodiments, the communication link quality comparison 330 may be based on environment and protocol characteristics. For example, if the environment causes multipath interference, a 2.4 GHz protocol may be selected to avoid multipath fading often exhibited by a 900 MHz protocol. In other embodiments, the communication link quality comparison 330 may use information provided by a hearing aid physical layer (PHY) to determine the preferred RF band or protocol. For example, the PHY may provide information about the bit error rate or forward error correction in the available communication links.

After the quality of available communication links have been compared 330, the status change method 300 may switch back to the first link 335 if the first link quality exceeds the second link quality. Alternatively, if the communication link quality comparison 330 identifies a third communication link that is expected to perform better than then first or second communication link, the status change method 300 may select the third communication link. For example, a third communication link may include a cellular band, a local wireless network protocol, a short-range wireless communication link, or another wireless communication link.

In an alternative embodiment, the status change method 300 may not immediately switch to a second communication link 315 and may perform additional analysis before making changes to the communication link, such as in steps 340, 345, or 350. This additional analysis may occur if the performance is degraded but does not fall below a minimum threshold performance. For example, if hearing aid audio quality is slightly degraded but the hearing aid is able to continue operation, the hearing aid might analyze the available alternative communication links before switching to a second communication link. The additional analysis may include identifying all available communication links 340, performing LQA on each available communication link 345, and comparing the quality of all available communication links 350. After the quality of available communication links have been compared 350, the status change method 300 may switch back to the second link 355 if the second link quality exceeds the first link quality. Alternatively, if the communication link quality comparison 330 identifies a third communication link that is expected to perform better than the first or second communication link, the status change method 300 may select the third communication link.

Figure 4:
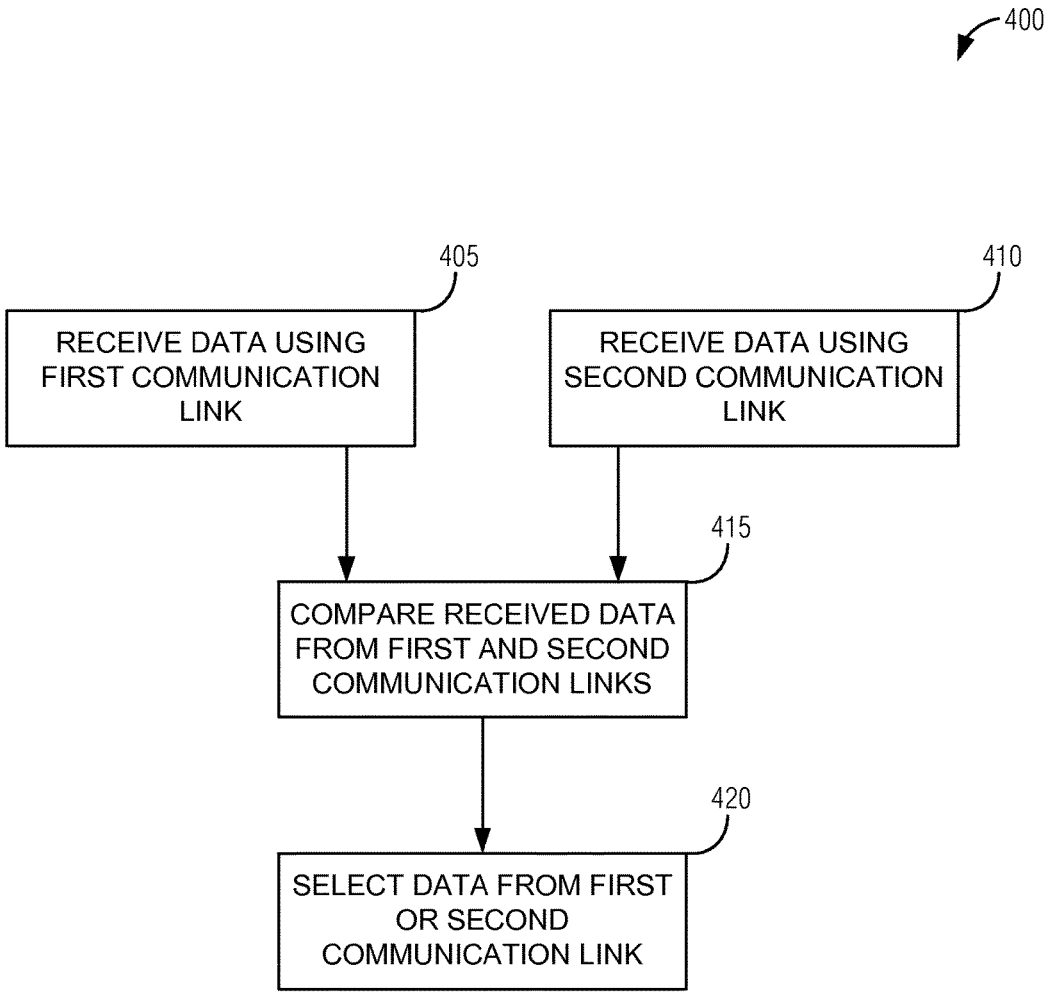
FIG. 4 shows an example hearing assistance RF multi-band method of comparing concurrent communication links.

FIG. 4 shows an example hearing assistance RF multi-band method of comparing concurrent communication links 400. Though FIG. 4 depicts receiving data on two bands, any number of current communication links may be used. With multiple bands, the hearing aid has may send different data on each band, yielding a higher data rate (e.g., bandwidth, throughput). Alternatively, redundant information may be sent on the multiple bands, which may improve data integrity or reception distance. Data packet errors may be detected or corrected using various data integrity metadata, such as error-correcting code (e.g., convolutional coding, trellis coded modulation, forward error correction), a cyclic redundancy check (CRC), or other methods. The multi-band approach may be more likely to result in error-free reception, as RF signal propagation in different RF bands will exhibit different characteristics. Data error correction may be improved by interleaving data throughout two or more bands. For example, error-correcting codes may be able to correct occasional bit errors, but may have difficulty correcting bursts of errors (e.g., a large group of consecutive bit errors). By interleaving the data between two or more bands, bursts of errors may be spread over multiple data packets, and the error-correcting codes may be able to correct the few bit errors in each data packet. Redundant data may be sent using methods that do not include a CRC or other data integrity verification to allow redundant data to be transmitted even if there is an error within the data. For example, because a CRC may be used to discard any packet that includes a detected error, avoiding using a CRC may enable more of the redundant information to be received and compared.

The concurrent communication link method 400 may use multiple concurrent data transfers to improve the speed or reliability of the transferred data, such as in a multiple-input and multiple-output (MIMO) configuration. As with other MIMO implementations, the use of multiple concurrent data transfers may use multiple collocated or spatially diverse antennas. A multiple-antenna configuration may improve reliability by improving spatial diversity gain (e.g., antenna diversity gain). A multiple-antenna configuration may also allocate transmission power among multiple transmission or reception antennas, thereby increasing bandwidth by improving the power gain (e.g., array gain).

Sending redundant information may improve reception distance. The range of various RF bands may be increased or decreased based on the current multipath or RF environment, and a multi-band hearing aid may select from among the multiple redundant RF bands. For example, operation on multiple RF bands may enable the hearing aid to receive a signal from all RF bands in range, and the hearing aid may select the RF band with the strongest signal and the wireless communication link that is most stable and error-free.

The concurrent communication link method 400 may include receiving data using a first communication link 405 and receiving data using a second communication link 410. For example, the first communication link may operate in the 900 MHz RF band and the second communication link may operate in the 2.4 GHz band. The data may be received simultaneously using two or more different RF bands, and once received, the data from the first and second communication links may be compared 415. Various forms of data integrity metadata may be compared to verify data integrity. For example, the data integrity may be verified by verifying a checksum associated with the data, such as using a parity byte, a cyclic redundancy check (CRC), or other data integrity verification. Various signal quality metrics of the first and second communication links may be compared, such as comparing the RSSI, PER, or other metrics. After comparing the data and communication links 415, the concurrent communication link method 400 may select data from the first or second communications link 420. The concurrent communication link method 400 may be repeated several times per second, and may enable a hearing aid in a noisy RF environment to switch quickly between RF bands to use the best available data. The concurrent communication link method 400 may reduce the power consumption during testing by sequentially cycling through all available RF bands or protocols, such that only a single RF band or protocol is tested at a time.

In addition to using multiple simultaneous RF bands, a frequency-hopping spread spectrum (FHSS) may be used to improve wireless communication. FHSS may be used to switch between (e.g., to hop between) two or more RF bands, or may be used within a single RF band such as Bluetooth. FHSS may be used by a radio to reduce narrow-band interference, multipath interference, or interference with other transmissions. A radio may also use FHSS to increase data integrity, as FHSS radio signals may be difficult to intercept or spoof.

Figure 5:
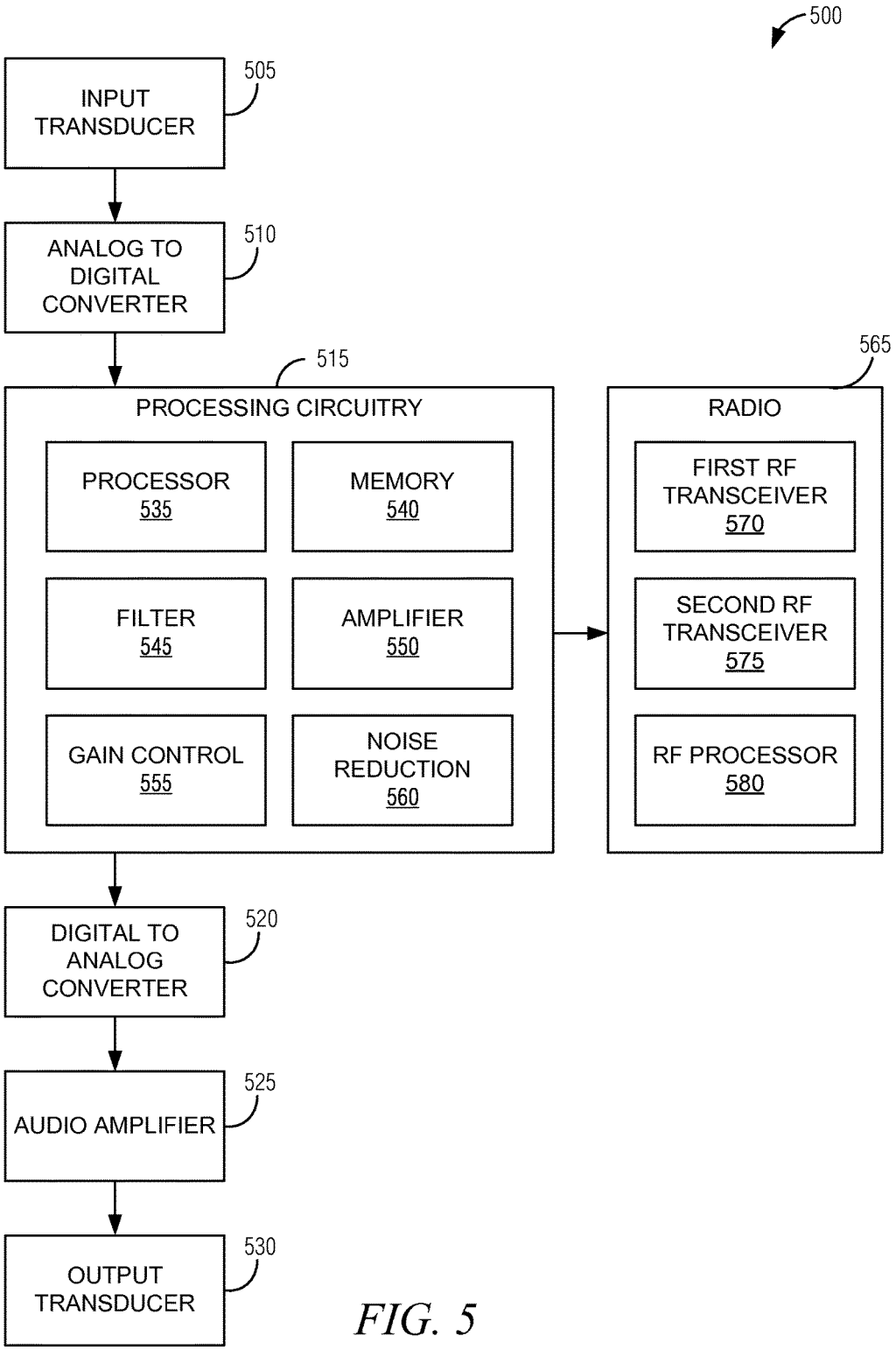
FIG. 5 shows example basic components of a multi-band hearing assistance device.

FIG. 5 shows example basic components of a multi-band hearing assistance device 500. Each hearing assistance device may include a microphone or other input transducer 505. The input transducer 505 may receive sound waves from the environment and convert the sound into an analog input signal that is sampled and digitized by the analog to digital (A/D) converter 520. Additional embodiments may incorporate an input transducer that directly produces a digital output. The device may include processing circuitry 515 that processes the digitized input signal into an output signal in a manner that compensates for a hearing deficit of a patient. The output signal may be converted to an analog signal from a digital signal using a digital to analog (D/A) converter 520. The digital output signal may be passed to an audio amplifier 525 that may be used to drive an output transducer 530 for converting the output signal into an audio output, where the output transducer 530 may be a speaker within an earphone.

The processing circuitry 515 may perform one or more of the methods describe above. The processing circuitry 515 may include a programmable processor 535 and associated memory 540 for storing and executing executable code and data. The operation of the device may be determined by the executable code and data stored on the memory 540. The executable code and data may be modified using an external device, such as through the radio 565. The external device may allow user input of data, where the data may include parameters affecting device operation. The radio 565 may include first and second RF transceivers 570 and 575, and may allow communication with a variety of external devices for configuring the hearing aids, where the external devices may include industry standard hearing aid programmers, wireless devices, belt-worn appliances, or other devices. Though FIG. 5 depicts radio 565 including a first RF transceiver 565 and a second RF transceiver 570, the radio 565 may include three or more RF transceivers to communicate using multiple RF bands using various protocols. Alternatively, radio 565 may include a single transceiver for multiple bands or protocols. Radio 565 may also include a separate RF processor 580.

In addition to the automated RF band selection described above, the RF band may be manually selectable by a hearing aid user or audiologist to improve performance in a particular application or environment. The RF band may be selected by the user to improve hearing assistance performance or reduce power consumption. The RF band may be selected by the audiologist according to various testing or programming equipment used by the audiologist. By providing the audiologist with user-selectable RF bands, the audiologist need not have separate programming equipment corresponding to each band used in hearing assistance devices. The RF band may be selected to comply with local regulatory requirements. For example, an external device may be used to transmit a list of RF bands that are appropriate for use in the current geographic location to the hearing aid, and the hearing aid may select an RF band from the list.

To enable multi-band operation, the hearing aid radio 565 may be connected to a multi-resonance antenna to send and receive RF signals on multiple frequency bands. The multi-resonance antenna may include active circuitry that could allow switching resonance between bands. Multi-band operation may also use variations of the folded J antenna, a multi-band planar inverted F-antenna (PIFA), or other multi-resonance antenna topologies. Multiple physical antennas may be used and arranged to optimize the wireless quality and reliability through antenna diversity.

The processing circuitry 515 may include a programmable processor 535 and associated memory 540 for storing and executing executable code and data. The processing circuitry 515 may also include various digital signal processing (DSP) modules 545, 550, 555, or 560. The DSP modules 545, 550, 555, or 560 may represent software code executed by the processor 535, or may represent additional hardware components. The processing performed by these modules may be performed in the time domain or in the frequency domain. Processing performed in the frequency domain may apply a discrete Fourier transform (DFT) to the input signal prior to processing, and may use an inverse Fourier transform (IFT) to produce the output signal for converting into sound. Processing functions may also be performed for multiple channels specific to audio frequencies, each of which corresponds to an audio frequency component or audio band of the audio input signal. Because hearing loss in patients often occurs non-uniformly over the audio frequency range and most commonly in the high frequency range, the patient's hearing deficit may be compensated by amplifying specific frequencies at which the patient has a below-normal hearing ability. This frequency-specific processing may be referred to as audio multichannel processing or audio multi-band processing. Frequency-specific audio processing may also use a filter module 545 or an amplifier module 550 to filter or amplify an input audio signal in a frequency-specific manner. The filter module 545 may include multiple filters in a filter bank configuration. In the time domain technique, a filter bank may be used to separate an input audio signal into several audio frequency bands. The lowest audio frequencies may be output by a low-pass filter, the highest audio frequencies by a high-pass filter, and the remaining intermediate audio frequencies by band-pass filters. The input audio signal may be convolved with the filters one sample at a time, and the output signal may be formed by summing the filter outputs. An alternative frequency domain technique may divide the input signal into short segments, transform each segment into the frequency domain, process the frequency domain segments as the computed input spectrum, and inverse-transform the segments to provide the output in the time domain.

The gain control module 555 may adjust the amplification dynamically in accordance with the amplitude of the input signal. The gain control module 555 may compress or expand the dynamic range of the input signal, and may be referred to as a compressor. The gain control module 555 may decrease the gain of the filtering and amplifying circuit at high input signal levels to avoid amplifying louder sounds to uncomfortable levels. The gain control module 555 may also apply compression in a frequency-specific manner. The noise reduction module 560 may suppress ambient background noise, may provide feedback cancellation, or may provide other noise-reducing features. Various hearing assistance audio enhancement techniques may be performed in either the time domain or frequency domain, and discrete segments of the input audio signal may be joined together to form the final output audio signal.

It is understood that variations in communications circuits, protocols, antenna configurations, and combinations of components may be employed without departing from the scope of the present subject matter. Hearing assistance devices typically include an enclosure (e.g., housing), a microphone, a speaker, a transceiver, and hearing assistance device electronics including processing electronics. It is understood that in various embodiments the transceiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that a variety of hearing assistance devices may be used without departing from the scope and the devices described herein are intended to demonstrate the subject matter, but not in a limited, exhaustive, or exclusive sense. It is also understood that the present subject matter can be used with devices designed for use in the right ear or the left ear or both ears of the wearer.

It is understood that hearing aids typically include a processor 535. The processor 535 may be a digital signal processor (DSP), microprocessor, microcontroller, other digital logic, or combinations thereof. The processing of signals referenced in this application can be performed using the processor 535. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples may omit certain modules that perform frequency synthesis, frequency analysis, analog-to-digital conversion, digital-to-analog conversion, amplification, and certain types of filtering and processing. In various embodiments, the processor 535 is adapted to perform instructions stored in memory that may or may not be explicitly shown. Various types of memory may be used, including volatile and nonvolatile forms of memory. In various embodiments, instructions are performed by the processor 535 to perform a number of signal processing tasks. In such embodiments, analog components may be in communication with the processor 535 to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), receiver-in-canal (RIC), and completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used with in-the-ear (ITE) and in-the-canal (ITC) devices. The present subject matter can also be used with wired or wireless ear bud devices. The present subject matter can also be used in hearing assistance devices generally, such as cochlear implant type hearing devices and such as deep insertion devices having a transducer, such as a receiver or microphone, whether custom fitted, standard, open fitted, or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

The preceding detailed description of the present subject matter refers to subject matter in the accompanying drawings that show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

What is claimed is:

1. A method for multi-band operation in a hearing assistance device, the method comprising:

detecting, in a hearing assistance device, a degraded performance of a first communication link, the first communication link being used as a current communication link to conduct wireless communication, the first communication link having an associated first communication link quality, the first communication link associated with a first radio frequency (RF) band; and in response to detecting the degraded performance:

identifying a second RF band communication link from among a plurality of RF band communication links available for use by the hearing assistance device, the second communication link having an associated second communication link quality;

comparing the second communication link quality to the first communication link quality;

determining, based on the comparison between the second communication link quality and the first communication link quality, that the second communication link quality is higher than the first communication link fatality; and selecting the second communication link as the current communication link to conduct wireless communication by the hearing assistance device in response to the determination that the second communication link quality is higher than the first communication link quality.

2. The method of claim 1, further including detecting a second degraded performance of the second communication link; and in response to detecting the second degraded performance:

identifying a third RF band communication link from among the plurality of RF band communication links, the third communication link quality determined to use a communication protocol different from the first and second RF band communication links; and selecting the third communication link for wireless communication by the hearing assistance device.

3. The method of claim 1, wherein:

the first RF band communication link has an associated first radio frequency band;

the second RF band communication link has an associated second radio frequency band; and determining the first RF band communication link quality is higher than the second RF band communication link quality includes determining that the second radio frequency band performs better than the first radio frequency band.

4. The met hod of claim 1, wherein detecting the degraded performance of the first communication link includes determining a degraded performance level falls below a minimum performance threshold.

5. The method of claim 1, wherein comparing the second communication link quality with the first communication link quality includes comparing a plurality of received signal strength indications (RSSIs).

6. The method of claim 1, wherein comparing the second communication link quality with the first communication link quality includes comparing a plurality of packet error rates (PERs).

7. The method of claim 1, further including receiving a geographic location, wherein:

identifying the second RE band communication link includes using the geographic information to identify a plurality of locally permissible RF bands; and selecting the second RF band communication link includes selecting the second RF band communication link from among the plurality of locally permissible RF bands.

8. The method of claim 1, further including detecting a multipath event on the first communication link, wherein selecting the second communication link is further in response to determining a second RF band multipath environment performance is better than a first RF band multipath environment performance.

9. The method of claim 1, further including detecting a low battery event, wherein selecting the second communication link is further in response to determining a second RF band power consumption is lower than a first RF band power consumption.

10. A hearing aid for a wearer having a hearing impairment, the hearing aid adapted to perform wireless communications, the hearing aid comprising:

a multi-band antenna;

a receiver comprising a multi-band radio with frequency control adapted to provide operation in a plurality of RF bands, the receiver adapted to receive signals from one or more antennas; and a processor in communication with the multi-band radio, the processor adapted to:

detect a degraded performance of a first communication link, the first communication link being used as a current communication link to conduct wireless communication, the first communication link having an associated first communication link quality, the first communication link associated with a first radio frequency (RF) band; and in response to detecting the degraded performance:

identify a second RF band communication link from among a plurality of RF band communication links available for use by the hearing aid, the second communication link having an associated second communication link quality;

comparing the second communication link quality to the first communication link quality;

determining, based on the comparison between the second communication link quality and the first communication link quality, that the second communication link quality is higher than the first communication link quality; and select the second communication link as the current communication link to conduct wireless communication by the hearing aid in response to the determination that the second communication link quality is higher than the first communication link quality.

11. The hearing aid of claim 10, the processor is further adapted to detect a second degraded performance of the second communication link; and in response to detecting the second degraded performance:

the processor further adapted to identify a third RF band communication link from among the plurality of RE band communication links, the third communication link quality determined to use a communication protocol different from the first and second RF band communication links; and the processor further adapted to select the third communication link for wireless communication by the hearing assistance device.

12. The hearing aid of claim 10, wherein:

the first RF band communication link has an associated first radio frequency band;

the second RF band communication link has an associated second radio frequency band; and the processor determining the first RF band communication link quality is higher than the second RF band communication link quality includes the processor determining that the second radio frequency band performs better than the first radio frequency band.

13. The hearing aid of claim 10, wherein detecting the degraded performance level on the first communication link includes determining a degraded performance level falls below a minimum performance threshold.

14. The hearing aid of claim 10, wherein the processor comparing the second RF band communication link quality with the first RF band communication link quality includes comparing a plurality of received signal strength indications (RSSIs).

15. The hearing aid of claim 10, wherein the processor comparing the second RF band communication link quality with the first RF band communication link quality includes comparing a plurality of packet error rates (PERs).

16. The hearing aid of claim 10, the processor further adapted to receive a geographic location, wherein:

the processor identifying the second RF band communication link includes using the geographic information to identify a plurality of locally permissible RF bands; and the processor selecting the second RF band communication link includes selecting the second RF band communication link from among the plurality of locally permissible RF bands.

17. The hearing aid of claim 10, the processor further adapted to detect a multipath event on the first communication link wherein the processor determining the second communication link quality is higher than the first communication link quality includes determining the second RF band multipath environment performance is better than the first RF band multipath environment performance.

18. The hearing aid of claim 10, the processor further adapted to detect a low battery event wherein the processor determining the second communication link quality is higher than the first communication link quality includes determining the second RF band power consumption is lower than the first RF band power consumption.

19. The hearing aid of claim 10, wherein the multi-band radio is adapted to perform one or more of:

ear-to-ear communications, ear-to-remote device communications, wireless programming, configuration and data logging streaming audio, bi-directional audio, or remote control.

20. The hearing aid of claim 10, wherein the multi-band radio performs transmissions controllable by the processor.

21. The hearing aid of claim 10, wherein the processor is adapted to perform frequency control of a local oscillator of the multi-band radio.

22. The hearing aid of claim 10, further comprising a first radio associated with the first RF band and a second radio associated with the second RF band, the first radio and second radio connected to the processor to provide received information to the processor.

23. The hearing aid of claim 22, further comprising a multiplexer configured to selectably receive the information from the first radio and from the second radio and provide the information to the processor.

24. The hearing aid of claim 10, wherein the multi-band radio is realized at least partially using an integrated circuit.

25. The hearing aid of claim 10, further comprising a microphone to receive sound and convert it to an electrical signal that is provided to the processor.

26. The hearing aid of claim 25, further comprising a receiver adapted to receive processed signals from the processor and to play sound for the wearer using the signals.

27. The hearing aid of claim 10, wherein the multi-band antenna includes a plurality of antenna elements, each antenna element configured to operate at a selected RF band.

* * * * *